US006020810A

United States Patent [19]

Har-Even

[11] Patent Number: 6,020,810

[45] Date of Patent: Feb. 1, 2000

[54] AUTOMATIC ELECTRONIC DATE/MATE FINDER AND METHOD OF ELECTRONICALLY FINDING A DATE/MATE

[76] Inventor: Eva A. Har-Even, 25 E. Salem St., Fort Lee, N.J. 07601

[21] Appl. No.: 09/176,828

[22] Filed: Oct. 22, 1998

[51] Int. Cl.[7] ..... G08B 3/00

[52] U.S. Cl. ..... 340/328; 340/326; 340/825.3; 379/93.17; 379/93.25; 707/104

[58] Field of Search ..... 340/328, 326, 340/825.29, 825.3, 825.35; 379/90.01, 93.17, 93.25; 707/2, 3, 104; 455/575; 709/253

[56] References Cited

U.S. PATENT DOCUMENTS

| | | | |
|---|---|---|---|
| 4,254,404 | 3/1981 | White | 340/323 R X |
| 4,348,744 | 9/1982 | White | 709/253 |
| 5,327,544 | 7/1994 | Palazzi, III | 348/13 |
| 5,440,559 | 8/1995 | Gaskill | 370/95.1 |
| 5,618,045 | 4/1997 | Kagan et al. | 463/40 |
| 5,621,456 | 4/1997 | Florin et al. | 348/7 |
| 5,664,115 | 9/1997 | Fraser | 705/37 |
| 5,676,551 | 10/1997 | Knight et al. | 434/236 |
| 5,682,196 | 10/1997 | Freeman | 348/13 |
| 5,724,357 | 3/1998 | Derks | 370/413 |

*Primary Examiner*—Daryl Pope
*Attorney, Agent, or Firm*—Richard M. Goldberg

[57] ABSTRACT

An automatic electronic date/mate finder includes a portable case; a screen on the portable case for viewing personal questions about a first person and/or a person that the first person would like to meet; a keypad on the portable case for inputting data corresponding to answers to the personal questions; a random access memory for storing the data input by the keypad; a transceiver in the portable case for transmitting the input data, and for receiving data corresponding to answers to the personal questions about a second person and/or a person that the second person would like to meet, that are transmitted by another automatic electronic date/mate finder; an audible alarm in the portable case; and a central processing unit in the portable case and connected to the alarm, the transceiver, the keypad and the screen, for coding the input data prior to transmission thereof, comparing the transmitted data with the received data, determining a percentage match of the transmitted data with the received data, and activating the alarm when the percentage match is greater than a predetermined percentage match.

12 Claims, 3 Drawing Sheets

AUTOMATIC ELECTRONIC DATE/MATE FINDER AND METHOD OF ELECTRONICALLY FINDING A DATE/MATE

BACKGROUND OF THE INVENTION

The present invention relates generally to an electronic matching device, and more particularly, is directed to an automatic electronic date/mate finder.

The process of finding a date/mate is generally a trial and error process, involving much time and money. With the high incidence of divorce, it is clear that this process is greatly fallible.

Various services have been provided for finding a date/mate with high compatibility. However, these services are very expensive, and require time-consuming review of portfolios and videos of prospective dates/mates. In addition, in view of the large number of such services, the pool from which the selections are made are relatively small in comparison with the overall general population.

OBJECTS AND SUMMARY OF THE INVENTION

Accordingly, it is an object of the present invention to provide an automatic electronic date/mate finder that overcomes the problems with the aforementioned prior art.

It is another object of the present invention to provide an automatic electronic date/mate finder that can find a compatible date/mate at any time and any place.

It is still another object of the present invention to provide an automatic electronic date/mate finder that can find a compatible date/mate without extensive review of portfolios and videos.

It is a further object of the present invention to provide an automatic electronic date/mate finder that automatically signals when a compatible date/mate is found.

It is a still further object of the present invention to provide an automatic electronic date/mate finder that is inexpensive and easy to use.

It is a yet further object of the present invention to provide an automatic electronic date/mate finder with a portable transceiver carried by a person.

In accordance with an aspect of the present invention, an automatic electronic date/mate finder includes a portable case; a screen on the portable case for viewing personal questions about a first person and/or a person that the first person would like to meet; a keypad on the portable case for inputting data corresponding to answers to the personal questions; a transceiver in the portable case for transmitting the input data, and for receiving data corresponding to answers to the personal questions about a second person and/or a person that the second person would like to meet, that are transmitted by another automatic electronic date/mate finder; an alarm in the portable case; and a central processing unit in the portable case and connected to the alarm, the transceiver, the keypad and the screen, for comparing the transmitted data with the received data, determining a percentage match of the transmitted data with the received data, and activating the alarm when the percentage match is greater than a predetermined percentage match.

Preferably, the alarm includes an audible alarm, although a vibrating or visual alarm could likewise be used.

The keypad includes at least an affirmative/negative button for providing an affirmative/negative response; an arrow button for moving through various the personal questions and/or possible answers to the personal questions; and a transmit button for controlling the transceiver to transmit the data corresponding to the answers to the personal questions about the first person and/or a person that the first person would like to meet.

In addition, the automatic electronic date/mate finder includes a random access memory for storing the data input by the keypad for comparison with the received data, and a read only memory for storing a program used by the microprocessor for performing the functions of comparing, determining and activating.

In addition, the input data is coded prior to transmission thereof.

In accordance with another aspect of the present invention, a method of electronically finding a date/mate, includes the steps of viewing personal questions about a first person and/or a person that the first person would like to meet, on a screen of a first portable automatic date/mate finder; inputting data corresponding to answers to the personal questions into the first portable automatic date/mate finder; transmitting the input data; receiving data corresponding to answers to the personal questions about a second person and/or a person that the second person would like to meet, that are transmitted by a second portable automatic electronic date/mate finder; comparing the input data with the received data in the first automatic electronic date/mate finder; determining a percentage match of the input data with the received data; and activating an alarm when the percentage match is greater than a predetermined percentage match stored in the first automatic electronic date/mate finder.

The above and other objects, features and advantages of the present invention will become readily apparent from the following detailed description thereof which is to be read in connection with the accompanying drawings.

DETAILED DESCRIPTION OF THE PREFERRED EMBODIMENTS

Figure 1:
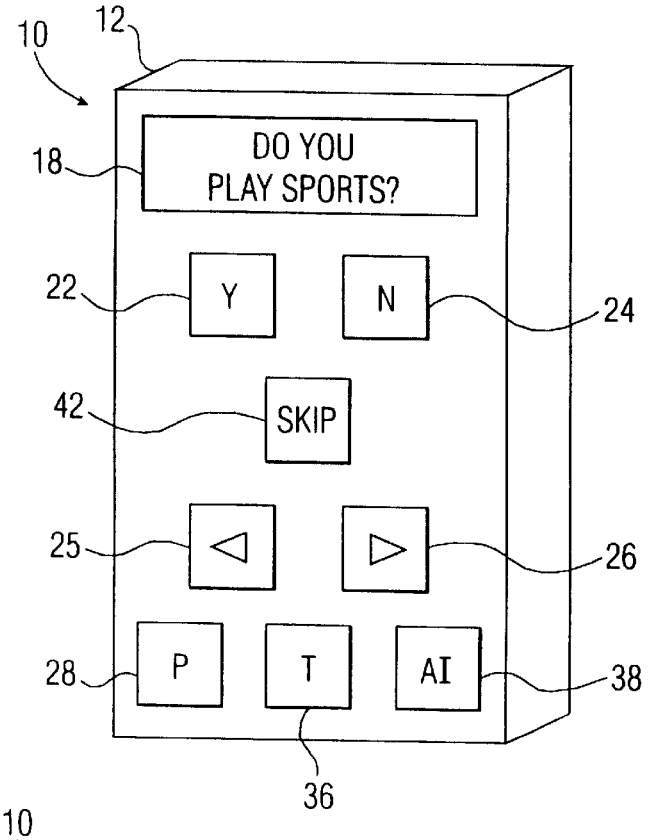
FIG. 1 is a perspective view of an automatic electronic date/mate finder according to one embodiment of the present invention.

Referring to the drawings in detail, an automatic electronic date/mate finder 10 according to one embodiment of the present invention includes a case 12, which is preferably a small case similar in size to a conventional electronic pager or a small electronic diary. Automatic electronic date/mate finder 10 includes a central processing unit (CPU) or microprocessor 14 which is connected with a working memory in the form of a random access memory (RAM) 16, a read only memory (ROM) 17 for storing a software program used by CPU 14, a screen 18, such as a liquid crystal display (LCD) screen, a light emitting diode (LED) screen, a plasma screen or the like, and a keypad 20. Screen 18 is preferably only a two or three line screen. RAM 16 is preferably a non-volatile memory so that data input into RAM 16 is maintained, even when power is turned off.

Keypad 20 can take any suitable form. For example, as shown in FIG. 1, keypad 20 includes a YES button 22 and a NO button 24 for responding in the affirmative or the negative to questions presented on screen 18. Left and right arrow buttons 25 and 26 are provided to move between various options provided on screen 18. In addition, keypad 20 includes a POWER button 28 for toggling between an ON and OFF condition of automatic electronic date/mate finder 10.

Automatic electronic date/mate finder 10 also includes a transceiver 30 connected with CPU 14 for transmitting data and for receiving data, transceiver 30 being connected with an antenna 32. Transceiver 30 can send a radio frequency (RF) signal in a circular area of, for example, defined by a radius of 500 feet. Preferably, the signal is a coded signal that is coded by CPU 14 so that only another similar automatic electronic date/mate finder 10 can decode the transmitted signal. In addition, automatic electronic date/mate finder 10 includes an alarm 34 for signaling when a compatible match has been found. Alarm 34 can take any suitable form, such as an audible alarm, a vibrating alarm, or even a visual alarm via screen 18.

In this regard, keypad 20 includes a TRANSMIT button 36 for transmitting data input by the user into RAM 16, via transceiver 30, and an ALARM INTERRUPT button 38 for deactivating or interrupting alarm 34.

Figure 2:
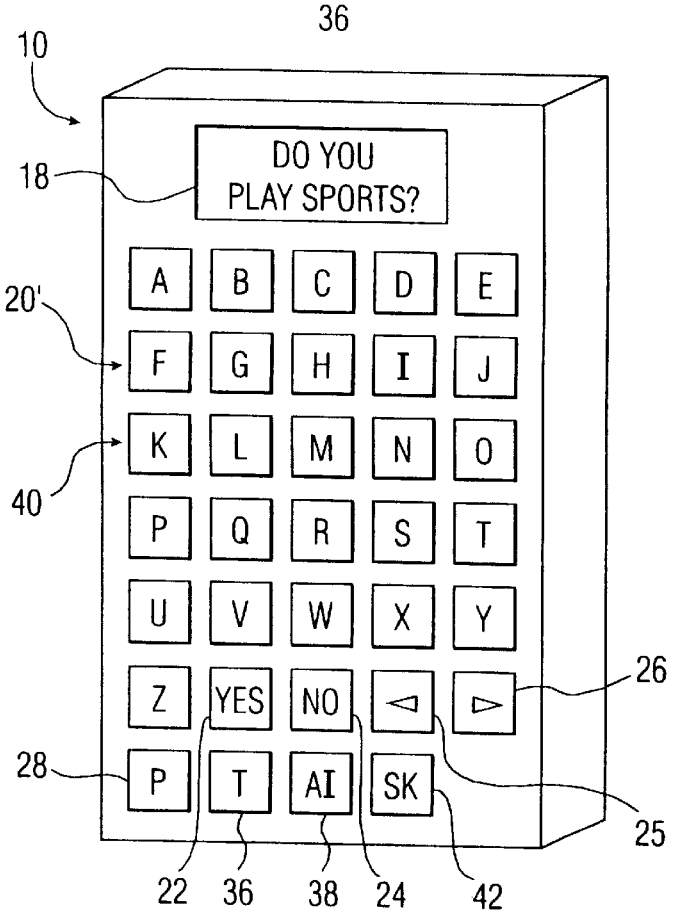
FIG. 2 is a perspective view of an automatic electronic date/mate finder according to another embodiment of the present invention.
Figure 3:
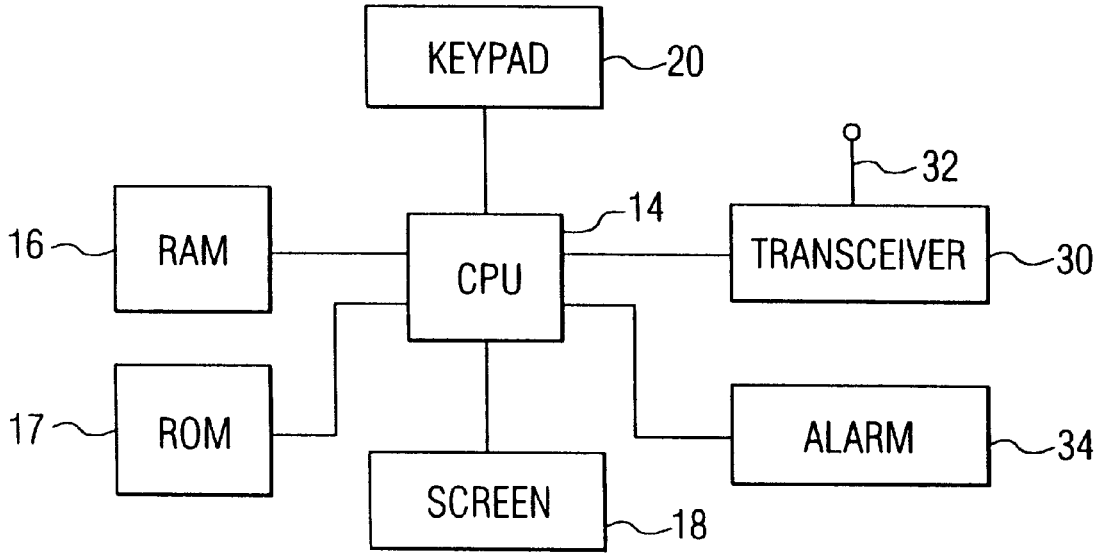
FIG. 3 is a block diagram of the circuitry within the automatic electronic date/mate finder according to either embodiment of the present invention.

Different variations of keypad 20 can be provided. For example, as shown in FIG. 2, keypad 20' has twenty-six additional keys 40 for the letters of the alphabet, so that a user can input specific answers to questions, rather than selecting from pre-programmed answers.

In operation, a user answers a number of personal questions about himself or herself and/or about a person he or she would like to meet. For example, upon powering up automatic electronic date/mate finder 10 by pushing POWER button 28 (Step 100), CPU 14 first makes a determination as to whether all pre-programmed questions have previously been answered by the user and stored in RAM 16 (Step 102). If not, CPU 14 causes a first pre-programmed question to appear on screen 18 (Step 104). For example, a first question could be "Do you play sports?". The user would then answer by depressing either YES button 22 or NO button 24 (Step 106). The answer to this question will depend on the next question that is answered. For example, if the user answers NO, the next question might be "Do you like watching sports?". On the other hand, if the user answers YES, the next inquiry might be "Select the sports you like playing" (Step 108). In such case, the user would use the arrow buttons 25 or 26, in conjunction with the YES and NO buttons 22 and 24. For example, the choices that are presented on screen 18 might be "a. Tennis b. Golf c. Softball d. Baseball e. Soccer f. Football g. Ice Skating h. Roller Blading i. Skiing j. Basketball k. Other l. Finish." The user, in Step 110, could select golf by using the right arrow button 26, followed by YES button 22, and also select skiing by using the right arrow button 26, followed by YES button 22. When finished, the selection "Finish" would be selected, and the answer would be stored in RAM 16. In the embodiment of FIG. 2, the particular letter keys "b" and "i" would be depressed instead of right arrow button 26. In addition, if "Other" is selected, the user could key in a sport not listed, such as "Bowling."

The questions that are asked would range to numerous topics, including personal data, such as sex, height, weight, age, etc., as well as education, interests, background, etc. regarding the user and also as to the person the user would like to meet.

Figure 5:
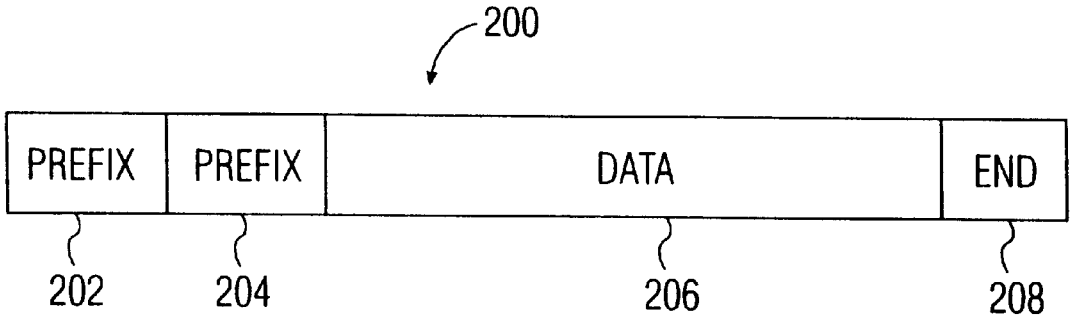
FIG. 5 is a block diagram of the format of the transmitted/received data.
Figure 4:
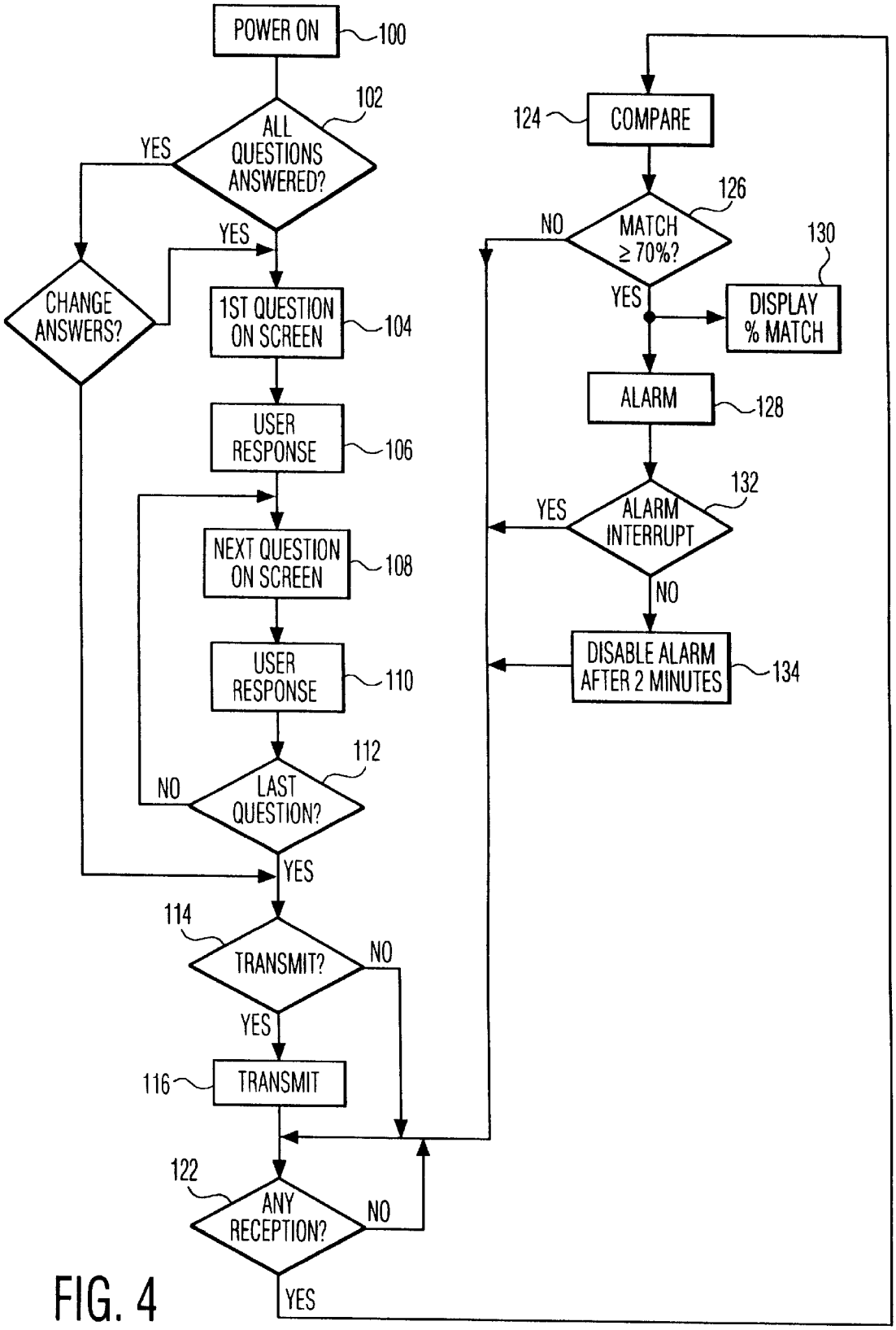
FIG. 4 is flow chart showing the operations of either automatic electronic date/mate finder.

After each response in Step 110, CPU 14 asks whether the last question has been presented and answered (Step 112). If no, the process returns to Step 108 to ask the next question. If yes, the process continues to Step 114 to ask the user if he or she wants to transmit the entered data (Step 114), that is, the entered answers to the aforementioned questions, which answers are stored in RAM 16. If yes, the user depresses TRANSMIT button 36, and the data is periodically transmitted in coded form, for example, once every two minutes (Step 116). The coding of the RF signal can take any suitable form. For example, as shown in FIG. 5, the coded signal 200 can take the form of a PREFIX code 202 which designates the type of automatic electronic date/mate finder 10 being used, followed by another PREFIX code 204 to designate a specific automatic electronic date/mate finder 10, then followed by the DATA 206 corresponding to the answers to the questions, and then an END signal 208 to indicate that transmission is complete.

Also, if upon turning power on in Step 100, CPU determines, in Step 102, that all questions have previously been answered, CPU 14 asks if the user wants to make any changes to the answers (Step 120). If no, the process also goes to Step 114 to determine if transmission is to occur. If yes, the process returns to Step 104 to go through the various questions again. Each question preferably has an option to skip the question so that the user can quickly pass through the questions that do not change. Alternatively, a separate SKIP button 42 can be provided for this purpose.

After transmission has occurred in Step 116, CPU 14 determines if there has been any coded signal received by another similar unit or automatic electronic date/mate finder 10 (Step 122). Specifically, there are a plurality of other such automatic electronic date/mate finders 10 that may be transmitting, for example, in the given area, such as a park, a street, a concert, etc. Each automatic electronic date/mate finder 10 receives all of the coded signals 200 from other automatic electronic date/mate finders 10. The first PREFIX code 202 is used to determine that the signal is from a similar automatic electronic date/mate finder 10 and is therefore proper, while the second PREFIX code 204 is used to separate the signals from the different automatic electronic date/mate finders 10.

Also, If TRANSMIT button 36 is not depressed in a predetermined time, for example, two minutes, the process proceeds directly to step 122. In this manner, a user can detect if there is a match before transmitting.

If there has not been any coded signal received by another similar unit in Step 122, the process returns to Step 122 to wait for any received signal from another automatic electronic date/mate finder 10. This process continues until a received signal is detected in Step 122. Then, CPU 14 compares the answers to the questions received by transceiver 30 from the other automatic electronic date/mate finder 10 with the answers stored in RAM 16, and determines the percentage of matching answers (Step 124). If the match is less than a pre-programmed percentage (Step 126), for example, 50% or 70%, the process returns to Step 122 for reception again. In addition, it may be possible through the questions asked, to change the percentage match. For example, if the user finds that there is no matching when the percentage is 70%, the user will have the ability to change the percentage match to a lower percentage, such as 60% or 50%.

If the percentage of matching answers is equal to or greater than the pre-programmed percentage (Step 126), CPU 14 activates alarm 34, for example, to emit an audible sound (Step 128). Since the other automatic electronic date/mate finder 10 is also transmitting and receiving, the alarm 34 of the other automatic electronic date/mate finder 10 will generally also be activated, unless the matching percentage is set to a different, higher level. The user then merely looks to find the user of the other automatic electronic date/mate finder 10 from which the other alarm sound is being emitted. The user can then approach that person, knowing beforehand that there is a high degree of compatibility. In addition, the specific percentage of compatible answers can be displayed on screen 18 (Step 130). Provision can also be made for the user to skip through the answers with a mark such as an asterisk or other mark provided next to the answer so that the user can see how they are compatible.

The user can interrupt or disconnect the alarm 34 at any time (Step 132). For example, once the user finds the person with the other audible alarm, there is no need for alarm 34 to continue. Also, if the user has no interest in the other person, he or she can turn off alarm 34 immediately as a sign that there is no interest. The interruption of alarm 34 can be for a predetermined time, for example, two minutes, or can be a toggle switch that turns alarm 34 on and off. If there is an alarm interrupt, the process returns to Step 122.

After alarm 34 is activated, and assuming ALARM INTERRUPT button 38 is not depressed, CPU 14 controls alarm 34 to turn off after a certain time period (Step 134), for example, after two minutes, to prevent draining of the batteries that power automatic electronic date/mate finder 10.

Thus, with the present invention, automatic electronic date/mate finder 10 can find a compatible date/mate at any time and any place, without extensive review of portfolios and videos, by a portable transceiver carried by a person. Automatic electronic date/mate finder 10 automatically signals when a compatible date/mate is found, and is inexpensive and easy to use.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. An automatic electronic date/mate finder comprising:

a portable case;

a screen on the portable case for viewing personal questions about a first person and/or a person that the first person would like to meet;

a keypad on the portable case for inputting data corresponding to answers to the personal questions, said keypad including:

at least one button for moving through various said personal questions and/or possible answers to the personal questions, and at least one button for selecting one of a plurality of answers to each question;

an antenna attached to the portable case for transmitting and receiving radio frequency signals;

a transceiver in the portable case for:

transmitting said input data by said radio frequency signal, and receiving data from an antenna corresponding to answers to said personal questions about a second person and/or a person that the second person would like to meet, that are transmitted by another said automatic electronic date/mate finder;

an alarm in the portable case for providing at least one of a visual and audio indication; and a central processing unit in the portable case and connected to said alarm, said transceiver, said keypad and said screen, for:

comparing the transmitted data with the received data, determining a percentage match of said transmitted data with said received data, and activating said alarm when the percentage match is any percentage match within a range of a less than 100 percent predetermined percentage match and a 100 percent match.

2. An automatic electronic date/mate finder according to claim 1, wherein said alarm includes an audible alarm.

3. An automatic electronic date/mate finder according to claim 1, wherein:

said at least one button for selecting one of a plurality of answers to each question includes an affirmative/negative button for providing an affirmative/negative response;

said at least one button for moving through various said personal questions and/or possible answers to the personal questions includes an arrow button for moving through various said personal questions and/or possible answers to the personal questions; and said keypad further includes a transmit button for controlling the transceiver to transmit said data corresponding to said answers to said personal questions about the first person and/or a person that the first person would like to meet.

4. An automatic electronic date/mate finder according to claim 1, further comprising a memory for storing said data input by said keypad for comparison with said received data.

5. An automatic electronic date/mate finder according to claim 1, wherein said memory is a random access memory.

6. An automatic electronic date/mate finder according to claim 1, further comprising a read only memory for storing a program used by said microprocessor for performing said functions of comparing, determining and activating.

7. An automatic electronic date/mate finder according to claim 1, wherein said central processing unit codes said input data prior to transmission thereof.

8. A method of electronically finding a date/mate, comprising the steps of:

viewing personal questions about a first person and/or a person that the first person would like to meet, on a screen of a first portable automatic date/mate finder;

inputting data corresponding to answers to said personal questions into the first portable automatic date/mate finder, including the steps of:

moving through various said personal questions and/or possible answers to the personal questions by at least one button on a keypad, and selecting one of a plurality of answers to each question by at least one button on a keypad;

transmitting said input data by a radio frequency signal;

receiving data from an antenna, said signal corresponding to answers to said personal questions about a second person and/or a person that the second person would like to meet, that are transmitted by a second portable automatic electronic date/mate finder;

comparing the input data with the received data in said first automatic electronic date/mate finder;

determining a percentage match of said input data with said received data; and activating an alarm which provides at least one of a visual and audio indication when the percentage match is any percentage match within a range of a less than 100 percent predetermined percentage match and a 100 percentage match.

9. A method according to claim 8, wherein said alarm includes an audible alarm.

10. A method according to claim 8, wherein:

said step of selecting includes the step of providing an affirmative/negative response via an affirmative/negative button on a keypad;

said step of moving through various said personal questions and/or possible answers to the personal questions includes the step of actuating an arrow button on the keypad; and said step of transmitting includes the step of controlling a transceiver via a transmit button on the keypad to transmit said data corresponding to said answers to said personal questions about the first person and/or a person that the first person would like to meet.

11. A method according to claim 8, further including the step of storing said input data in a memory in said first portable automatic date/mate finder.

12. A method according to claim 8, further comprising the step of coding said input data prior to transmission thereof.

* * * * *

UNITED STATES PATENT AND TRADEMARK OFFICE

CERTIFICATE OF CORRECTION

PATENT NO. : 6,020,810

DATED : February 1, 2000

INVENTOR(S) : Eva A. HAR-EVEN

It is certified that error appears in the above-identified patent and that said Letters Patent is hereby corrected as shown below:

On the title page: Item [76] change address to --2100 Linwood Avenue, Apt. 22J, Fort Lee, NJ 07024 --.

Signed and Sealed this

Nineteenth Day of December, 2000

*Attest:*

*Attesting Officer*

Q. TODD DICKINSON

*Commissioner of Patents and Trademarks*